US006612248B2

(12) United States Patent
Becker

(10) Patent No.: US 6,612,248 B2
(45) Date of Patent: Sep. 2, 2003

(54) WALL SEGMENT FOR A COMBUSTION AREA, AND A COMBUSTION AREA

(75) Inventor: Bernard Becker, Mulheim (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/993,161

(22) Filed: Nov. 7, 2001

(65) Prior Publication Data

US 2002/0050237 A1 May 2, 2002

Related U.S. Application Data

(62) Division of application No. 09/646,572, filed as application No. PCT/DE99/00542 on Mar. 1, 1999.

(30) Foreign Application Priority Data

Mar. 19, 1998 (DE) ..... 198 12 074

(51) Int. Cl.[7] ..... F23M 5/00

(52) U.S. Cl. ..... 110/336; 110/332; 60/752

(58) Field of Search ..... 110/314, 322, 110/323, 324, 325, 326, 336, 337, 338, 339, 340; 60/752, 753, 754, 755, 756, 757, 758, 759, 760

(56) References Cited

U.S. PATENT DOCUMENTS

| | | | | | |
|---|---|---|---|---|---|
| 3,584,972 | A | * | 6/1971 | Bratkovich | 416/229 |
| 4,441,324 | A | | 4/1984 | Abe et al. | |
| 4,642,993 | A | * | 2/1987 | Sweet | 60/752 |
| 4,709,643 | A | * | 12/1987 | Moreno et al. | 110/336 |
| 4,749,029 | A | * | 6/1988 | Becker et al. | 165/47 |
| 4,751,962 | A | | 6/1988 | Havekost et al. | |
| 4,809,645 | A | * | 3/1989 | Fournier | 122/6 A |
| 4,838,030 | A | * | 6/1989 | Cramer | 60/753 |
| 4,838,031 | A | * | 6/1989 | Cramer | 60/753 |
| 4,840,131 | A | | 6/1989 | Meumann et al. | |
| 4,934,322 | A | * | 6/1990 | Fournier et al. | 122/6 A |
| 4,944,151 | A | | 7/1990 | Hovnanian | |
| 5,033,959 | A | | 7/1991 | Bernt et al. | |
| 5,083,424 | A | * | 1/1992 | Becker | 60/39.31 |
| 5,129,223 | A | | 7/1992 | Doellner | |
| 5,216,886 | A | | 6/1993 | Ewing | |
| 5,265,411 | A | | 11/1993 | Belsom | |
| 5,331,816 | A | * | 7/1994 | Able et al. | 60/753 |
| 5,431,020 | A | | 7/1995 | Maghon | |
| 5,431,375 | A | | 7/1995 | Mitais et al. | |
| 5,592,814 | A | | 1/1997 | Palusis et al. | |
| 5,605,046 | A | * | 2/1997 | Liang | 60/752 |
| 5,624,256 | A | * | 4/1997 | Pfeiffer et al. | 432/252 |
| 5,957,067 | A | * | 9/1999 | Dobbeling et al. | 110/336 |
| 6,012,401 | A | * | 1/2000 | Orita et al. | 110/325 |
| 6,223,538 | B1 | | 5/2001 | Benz et al. | |

FOREIGN PATENT DOCUMENTS

| | | |
|---|---|---|
| DE | 2321561 | 11/1974 |
| EP | 0724116 | 7/1996 |
| WO | 9854367 | 12/1998 |

OTHER PUBLICATIONS

Database WPI, Derwent Publications Ltd., London, GB; AN 86–034116; & SU 1 167 202 A (UMET), Jul. 15, 1985.
Patent Abstracts of Japan, vol. 018, No. 151, Mar. 14, 1994 & JP 05 322455 A, (Kawasaki Steel Corp), Dec. 7, 1993.

* cited by examiner

*Primary Examiner*—Ira S. Lazarus
*Assistant Examiner*—K. B. Rinehart
(74) *Attorney, Agent, or Firm*—Harness, Dickey & Pierce P.L.C.

(57) ABSTRACT

A wall segment is for a combustion area to which a hot fluid can be applied. The wall segment includes a metallic supporting structure, with a heat protection element mounted on it. The metallic supporting structure is provided at least in places with a thin and/or metallic, heat-resistant separating layer. The separating layer is fitted between the metallic supporting structure and the heat protection element.

10 Claims, 4 Drawing Sheets

WALL SEGMENT FOR A COMBUSTION AREA, AND A COMBUSTION AREA

This application is a divisional of application Ser. No. 09/646,572 filed Sep. 19, 2000 (the entire contents of which are hereby incorporated herein by reference), which is the national phase under 35 U.S.C. §371 of PCT International Application No. PCT/DE99/00542 which has an International filing date of Mar. 1, 1999 which designated the United States of America, the entire contents of which are also hereby incorporated herein by reference.

FIELD OF THE INVENTION

Background of the Invention

The invention relates to a wall segment for a combustion area to which a hot fluid can be applied, in particular for a combustion chamber in a gas turbine. The invention also relates to a combustion area.

A thermally highly stressed combustion area, such as a furnace, a hot-gas channel or a combustion chamber in a gas turbine, in which a hot fluid is produced and/or carried, is provided with a lining for protection against excessive thermal stress. The lining is composed of heat-resistant material and protects a wall of the combustion area against direct contact with the hot fluid, and the severe thermal stress associated with this.

U.S. Pat. No. 4,840,131 relates to improved attachment of ceramic lining elements to a wall of a furnace. A rail system, which is attached to the wall and has a number of ceramic rail elements by means of which the lining elements are held is provided in this document. Further ceramic layers may be provided between a lining element and the wall of the furnace, including a layer composed of loose, partially compressed ceramic fibers, which layer has at least the same thickness as the ceramic lining elements, or a greater thickness. The lining elements in this case have a rectangular shape with a planar surface and are composed of a heat-insulating, fire-resistant ceramic fiber material.

U.S. Pat. No. 4,835,831 likewise relates to the fitting of a fire-resistant lining on a wall of a furnace, in particular a vertical wall. A layer composed of glass, ceramic or mineral fibers is fitted to the metallic wall of the furnace. This layer is attached to the wall by metallic brackets or by adhesive. A wire mesh network with honeycomb meshes is fitted to this layer. The mesh network is likewise used to protect the layer composed of ceramic fibers from falling off. A continuous, closed surface composed of fire-resistant material is applied to the layer secured in this way, by means of a suitable spraying method. The described method largely avoids fire-resistant particles produced during the spraying process from being thrown back, as would be the case if the fire-resistant particles were sprayed directly onto the metallic wall.

A lining for walls of highly stressed combustion areas is described in EP 0 724 116 A2. The lining comprises wall elements composed of high-temperature-resistant structural ceramic, such as silicon carbide (SiC) or silicon nitride ($Si_3N_4$), which are mechanically attached by means of a fastening bolt to a metallic supporting structure (wall) of the combustion chamber. A thick insulation layer is provided between the wall element and the wall of the combustion area, so that the wall element is at a distance from the wall of the combustion chamber. The insulation layer, which is three times as thick as the wall element, is composed of ceramic fiber material, which is prefabricated in blocks. The dimensions and the external shape of the heat protection segments can be matched to the geometry of the area to be lined.

Another type of lining for a thermally highly stressed combustion area is specified in EP 0 419 487 B1. The lining is composed of heat protection segments, which are held mechanically on a metallic wall of the combustion area. The heat protection segments touch the metallic wall directly. In order to avoid excessive heating of the wall, for example by direct heat transfer from the heat protection segment or by the ingress of hot active fluid into the gaps formed by mutually adjacent heat protection segments, the area formed by the wall of the combustion area and the heat protection segment has cooling air, so-called sealing air, applied to it. The sealing air prevents the hot active fluid from penetrating as far as the wall, and at the same time cools the wall and the heat protection segment.

SUMMARY OF THE INVENTION

The object of the invention is to specify a wall segment for a combustion area, in particular a combustion chamber in a gas turbine, to which a hot fluid can be applied. A further object is to specify a heat-resistant combustion area.

The object relating to a wall segment is achieved according to the invention by a wall segment for a combustion area, to which a hot fluid can be applied, having a metallic supporting structure and having a heat protection element which is mounted on the metallic supporting structure. The metallic supporting structure is provided at least in places with a thin, heat-resistant separating layer, with the separating layer being fitted between the metallic supporting structure and the heat protection element. Alternatively or additionally, the object is achieved by a wall segment in which, according to the invention a metallic, heat-resistant separating layer is fitted at least in places between the supporting structure and the heat protection element. The metallic separating layer may be thin.

The invention is based on the knowledge that the heat protection segment and the wall of a combustion area are composed predominantly of relatively inelastic materials such as structural ceramic and metal. A disadvantage of a lining designed in such a way for a combustion area is that the heat protection elements directly touch the wall of the combustion area. For production reasons and owing to the different thermal expansion of the wall and the heat protection element, the heat protection element may not always be able to lie flat on the wall. In consequence, high forces may be produced locally at the contact points. If the heat protection element and the wall have different thermal expansion characteristics, it is possible in unfavorable conditions for the heat protection segments and/or the wall to be damaged due to the introduction of high forces at the contact points when the operating state of the combustion area changes, for example in the event of a load change in a gas-turbine system. In consequence, gaps between the heat protection element and the wall may be formed between the contact points of the heat protection element and the wall, where there is no contact. These gaps form access channels for hot fluid. In order to prevent the ingress of hot fluid, an increased amount of sealing air would be required in this situation between the wall and the heat protection element.

The refinement of a wall segment according to the invention has the advantage that a deformable separating layer inserted between the metallic supporting structure and the heat protection element can absorb and compensate for possible relative movements of the heat protection element and of the supporting structure. Such relative movements can be caused, for example, in the combustion chamber of a gas turbine, in particular an annular combustion chamber, by the materials used having different thermal expansion characteristics or by pulsations in the combustion area. This can occur in the even of irregular combustion to produce the hot active fluid or as a result of resonance, for example. At the same time, the separating layer results in the relatively inelastic heat protection element lying flatter on the separating layer and on the metallic supporting structure overall, since the heat protection element penetrates into the separating layer in places. The separating layer can thus also compensate for irregularities, due to production effects, on the supporting structure and/or on the heat protection element, which can lead to disadvantageous introduction of forces at specific points, locally.

The heat-resistant separating layer inserted between the heat protection element and the metallic supporting structure can advantageously be deformed elastically and/or plastically by the heat production element. The heat protection element can thus penetrate into the heat resistant separating layer in places, and deform it, and compensate for irregularities in the contact surface of the heat protection element and/or of the supporting structure due to production effects and/or occurring as a result of operation of the system. Forces can thus be introduced over a larger area to the largely inelastic heat protection element, overall. Thus, the risk of damage to the heat protection element and/or to the metallic supporting structure is less than when forces are introduced via the direct contact, which occurs at specific points at least in places, between the heat protection element and the supporting structure. The deformation of the separating layer in places by the heat protection element also leads to a reduction in the gap openings between the heat protection element and the separating layer, which reduces the flow of hot fluid behind the heat protection element. In order to avoid, or at least reduce the flow behind the heat protection elements, sealing air can be applied to a cavity formed by the heat protection element and the metallic supporting structure. The requirement for sealing air is decreased by reducing the gap openings and reducing the size of the cavity volume by means of the separating layer.

The separating layer preferably has a thickness which is less than the height of the heat protection element. The expression height of the heat protection element in this case refers to the extent of the heat protection element in the direction at right angles to the surface of the metallic supporting structure. The height may in this case correspond directly to the layer thickness of the heat protection element. In the case of a domed, curved or cap-shaped heat protection element, the height is, in contrast, greater than the wall thickness of the heat protection element. The separating layer may have a layer thickness of up to a few millimeters. The layer thickness is preferably less than one millimeter, in particular up to a few tenths of a millimeter.

The heat-resistant separating layer preferably comprises a metal grid with honeycomb cells, which grid can be deformed by the heat protection element. The honeycomb cells of the metal grid are advantageously filled with a deformable filling material. The honeycomb cells may be produced from thin metal sheets, with a thickness of only a few tenths of a millimeter, for example from a nickel-based alloy. The filling material is preferably in the form of powder and is formed from a metal and/or a ceramic. The ceramic powders can be heated and transported in a plasma jet (atmospheric plasma spray). Depending on the nature of the powder and the spraying condition, a layer produced by the powder can be formed with a greater or lesser number of pores. The honeycomb cells are preferably filled with a porous layer, which can thus be deformed easily and provides good insulation. A metallic filling material is preferably formed from a heat-resistant alloy as is also used, for example, for coating gas turbine blades. A metallic filling material is formed, in particular, from a base alloy of the MCrAlY type, in which case M may be nickel, cobalt or iron, Cr chromium, Al aluminum and Y yttrium or some other reactive rare-earth element. During the deformation and penetration of the heat protection element into the separating layer, the deformable filling material closes the gap openings which exist between the contact surfaces, or reduces their size, which leads to a reduction in the requirement for sealing air. Furthermore, the separating layer reduces the volume of the cavity formed by the heat protection element and the supporting structure, as a result of which the requirement for sealing air is further reduced. In a gas turbine, the active fluid can furthermore be cooled by the cooler sealing air when said sealing air enters the combustion area, which can lead to a reduction in the overall efficiency of a gas turbine system being operated using the hot active fluid. The reduced requirement for sealing air in this case also leads to less reduction in overall efficiency than would be the case in a gas turbine system with heat protection elements but without a separating layer.

The heat-resistant separating layer may also advantageously comprise a felt composed of thin metal wires. Such a metal felt may also be laid on contours having very small radii of curvature. Thus, it is particularly suitable as a separating layer for a supporting structure with an irregular shape in a combustion area, for example a metallic supporting structure for holding heat protection elements, to which sealing air is applied, in the combustion chamber of a gas turbine. The thickness of the metal felt is chosen such that even relatively large gap openings between two contact surfaces of a heat protection element and the supporting structure can be closed, or at least greatly reduced in size, by the metal felt. It is thus possible to use a wall segment designed in such a way even in systems in which the amount of sealing air available is limited.

If the gap openings which result between the metallic supporting structure and the associated heat protection elements are relatively small and uniform, then the heat-resistant separating layer is preferably applied as a thin coating to the metallic supporting structure.

In order to make it possible to withstand the loads resulting from the ingress of hot fluid and to protect the metallic supporting structure effectively, the heat-resistant separating layer installed between the supporting structure and the heat protection element is designed to be scale-resistant at a temperature of more than 500° C., in particular up to approximately 800° C.

The heat protection element is advantageously mechanically connected to the metallic supporting structure of the combustion area. The contact force which the mechanical retention exerts on the heat protection element in the direction of the supporting structure, and thus the penetration depth of the heat protection element and the deformation of the heat-resistant separating layer, can be adjusted by means of a mechanical joint. The remaining gap openings and the requirement for sealing air which results from them can thus be matched to the operating conditions and to the amount of sealing air available at the respective point of use.

The heat protection element is advantageously held on the supporting structure by means of a bolt. The bolt acts approximately in the center of the heat protection element, in order to introduce the contact force as centrally as possible into the heat protection element. The heat-resistant separating layer has a recess in the region in which the bolt of the associated heat protection element is attached to the metallic supporting structure. Further recesses and openings in the separating layer, in particular in a gas turbine, are likewise provided wherever the supporting structure has channels for supplying sealing air into the cavity formed by the heat protection element and the supporting structure. Sealing air can thus flow into the cavity, thus making it possible to prevent the hot active fluid from flowing behind the heat protection elements and/or the separating layer.

The heat protection element can preferably also be mechanically held against the metallic supporting structure by means of a tongue-and-groove joint.

The object relating to a combustion area is achieved, according to the invention, by a combustion chamber forming a combustion area, in particular a combustion chamber in a gas turbine, which is formed from wall segments described above. In order to provide a heat-resistant lining for the combustion area, heat protection elements are fitted on a metallic supporting structure of the wall segment. The heat protection elements are, for example, in the form of flat or curved polygons with straight or curved edges, or of flat, regular polygons. They completely cover the metallic supporting structure which forms the outer wall of the combustion area, except for expansion gaps provided between the heat protection elements. Hot fluid can penetrate into the expansion gaps only as far as a heat-resistant separating layer on the wall segment, and cannot flow behind the heat protection elements. Mechanical holders for the heat protection elements, and the metallic supporting structure, are thus largely protected against being damaged by hot fluid.

BRIEF DESCRIPTION OF THE DRAWINGS

The wall segment and a combustion area will be explained in more detail with reference to the exemplary embodiments which are illustrated in the drawings. The following schematic illustrations are shown in the figures.

DETAILED DESCRIPTION OF THE PREFERRED EMBODIMENTS

Figure 1:
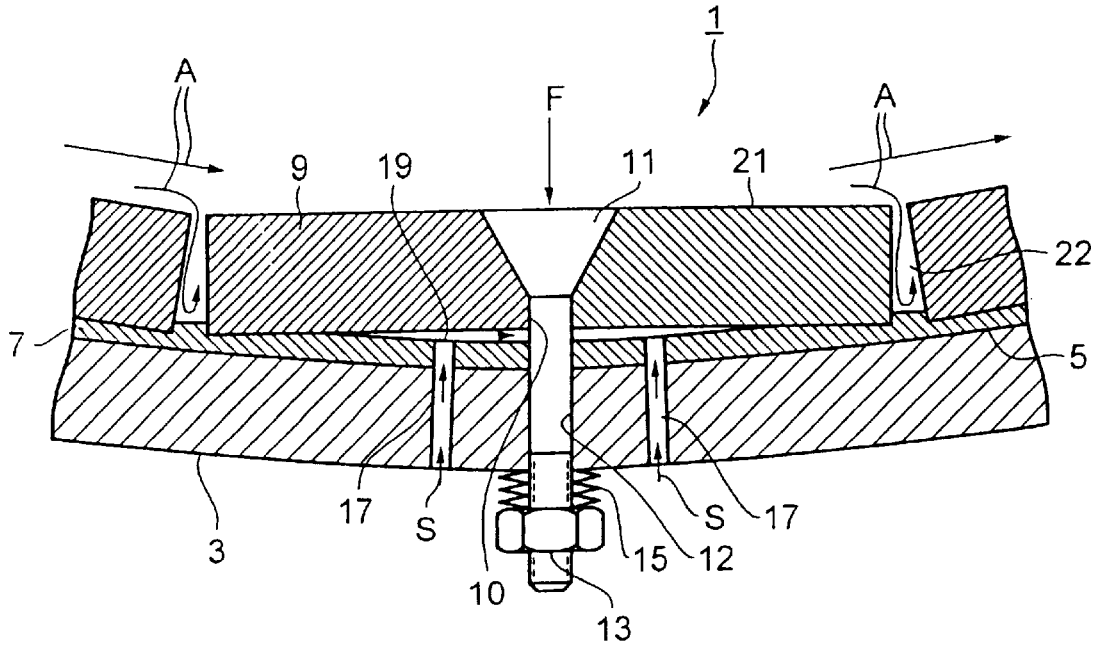
FIG. 1 shows a wall segment with a separating layer composed of a metal grid with filled, honeycomb cells on a curved supporting structure.

FIG. 1 shows a wall segment 1 of a gas turbine combustion chamber forming a combustion area 2, which is not illustrated in any more detail. The wall segment 1 comprises a metallic supporting structure 3, to whose internal wall 5, facing the combustion area 2, a heat-resistant separating layer 7 is applied.

Figure 1A:
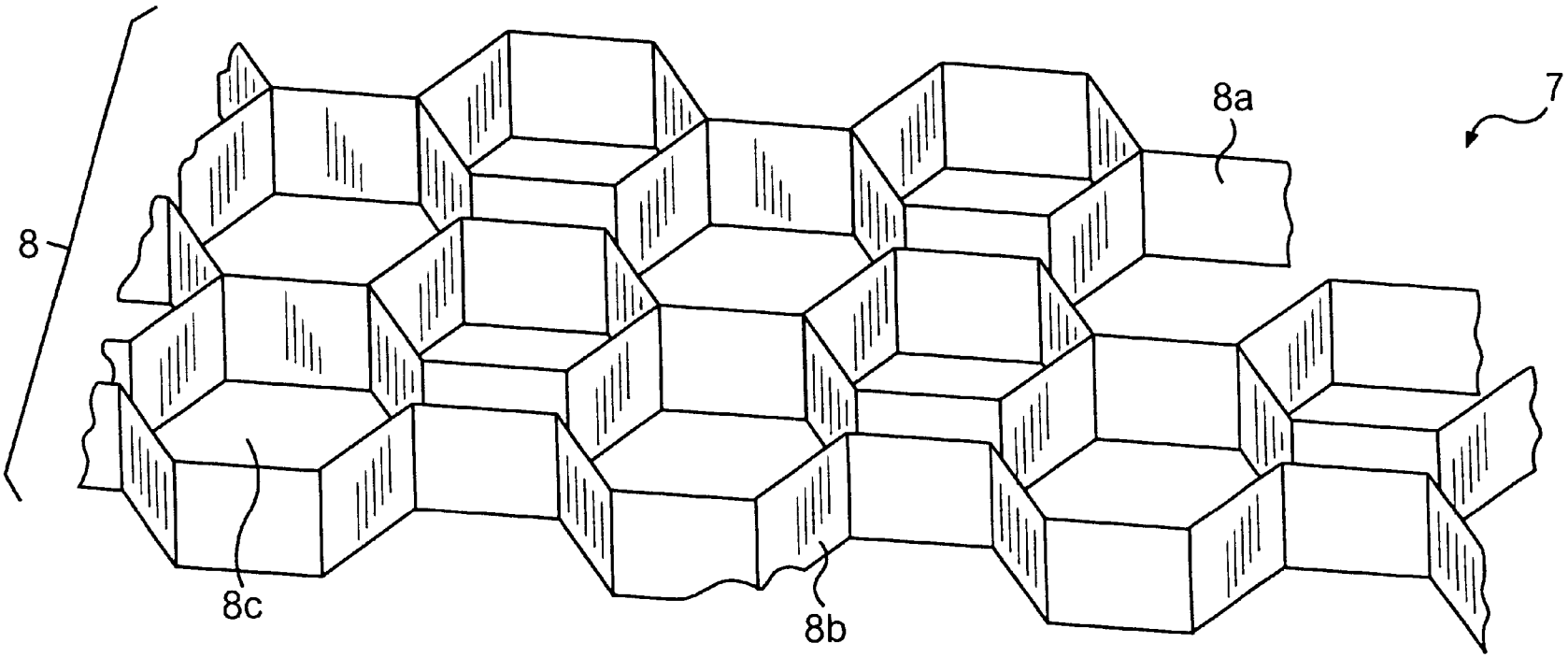
FIG. 1*a* shows the metal grid of the separating layer, in detail, forming honeycomb cells.

The heat-resistant separating layer 7 preferably includes a metal grid 8 with honeycomb cells, as shown in FIG. 1*a*. The metal strips 8*a* and 8*b* of the metal grid which form the honeycomb cells preferably have a height which corresponds to the thickness of the separating layer 7. The honeycomb cells of the metal grid are preferably filled with a deformable filling material 8*c*.

A ceramic heat protection element 9 is fitted on the combustion-area side of the separating layer 7. The ceramic heat protection element 9 is held on the metallic supporting structure by means of a bolt 11. The bolt 11 is held in a hole 10 in the ceramic heat protection element 9, and this hole runs essentially parallel to a perpendicular to a hot-gas side 21 of the heat protection element 9, through the region of the center of the heat protection element 9. In consequence, a contact force F produced by the bolt 11 is introduced essentially centrally into the heat protection element 9.

Figure 2:
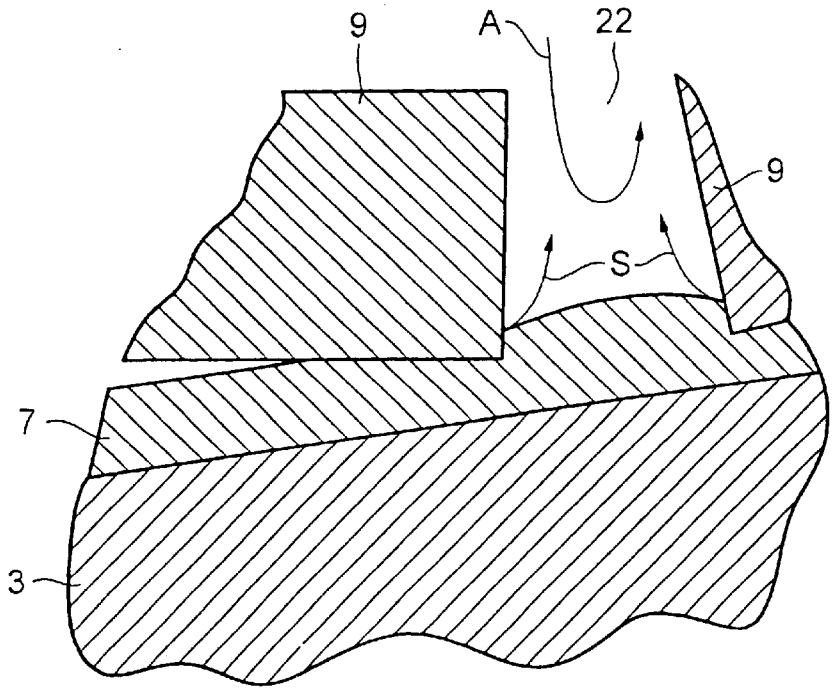
FIG. 2 shows enlarged details of FIG. 1.
Figure 2A:
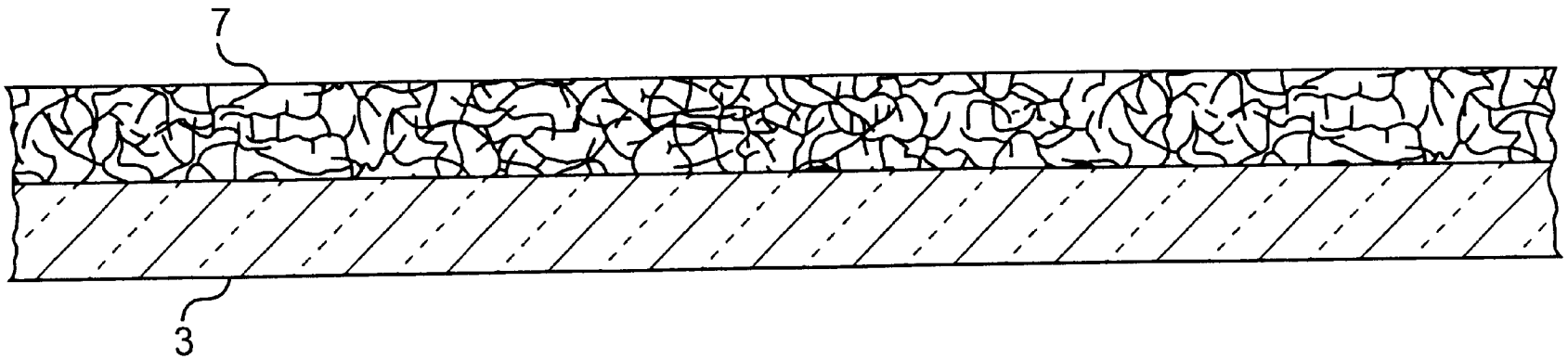
FIG. 2*a* shows a separating layer with a felt material including metal wires.

One end of the bolt 11 preferably projects through a hole 12 in the supporting structure 3. This end of the bolt 11 is closed off by a nut 13, which has an associated spring 15. The nut 13 makes it possible to adjust the contact force F applied to the heat protection element 9 via the bolt 11 held in hole 10, forming a type of tongue and groove joint. It is thus also possible at the same time to adjust the penetration depth of the heat protection element 9 into the separating layer 7, and thus its deformation. The greater the contact force F with which the heat protection element 9 is pressed onto the heat-resistant separating layer 7, the deeper the heat protection element 9 penetrates into the separating layer 7. FIG. 2 shows how the heat protection element 9 deforms the separating layer 7, and partially penetrates into it, as a result of the contact force F. FIG. 2*a* shows, for example, the separating layer 7 including a felt material including metal wires.

Channels 17 are provided in the metallic supporting structure 3, through which sealing air S can be applied to a cavity 19 formed by the heat protection element 9 and the supporting structure 3 with the separating layer 7. For this purpose, the separating layer 7 is provided with corresponding openings, which are not illustrated, at those points on the supporting structure 3 where channels 17 are provided, through which openings the sealing air S can enter the cavity 19. In the region in which the bolt 11 is held against the metallic supporting structure 3, the separating layer 7 has an opening, which is not shown in any more detail, in which the bolt 11 is held.

During operation of the gas turbine, hot active fluid A is produced in the combustion area 2 of the combustion chamber. The active fluid A is guided by the wall segment 1 on the hot-gas side 21 which faces the combustion area and is formed by the heat protection elements 9. The heat protection elements 9 prevent direct contact between the hot active fluid A and the metallic supporting structure 3. Expansion gaps 22, to compensate for length changes of the heat protection elements 9 are provided between adjacent heat protection elements 9, of a wall segment 3, for thermal expansion. Hot active fluid A can penetrate into these expansion gaps 22 as far as the separating layer 7. The deformable filling material of the heat-resistant separating layer 7 prevents direct contact between the active fluid A and the metallic supporting structure 3, seals the cavity 19 against the ingress of hot active fluid A, and thus prevents any flow behind the heat protection elements 9. The separating layer 7 is slightly domed in the region of the expansion gap 22 as a result of the longitudinal expansion of the heat protection elements 9, and thus additionally seals the cavity 19 against the ingress of active fluid A. In order to reinforce the barrier effect of the separating layer 7 and of the heat protection elements 9, sealing air S is applied to the cavity 19 through the channels 17. The sealing air S emerges into the expansion gaps 22 at those points which are not completely sealed against the hot active fluid A by the separating layer 7, as is shown schematically in FIG. 2. The pressure drop from the cavity 19 to the combustion area produced by the sealing air S prevents active fluid A from entering the cavity 19.

The different thermal expansion of the heat protection element 9 and of the metallic supporting structure 3 can lead to relative movements between the heat protection element 9 and the supporting structure 3 when load changes occur in the gas turbine. However, relative movements can also occur as a result of pulsations in the combustion area, caused by irregular combustion or resonances. Such relative movements which occur during operation can likewise be compensated for by the partially elastically deformable separating layer 7. The introduction of increased forces into the heat protection element 9 on the contact surfaces, for example as a result of a sudden pressure rise, can be reduced by the compression of the separating layer 7, and the enlarged contact area resulting from this.

Figure 3:
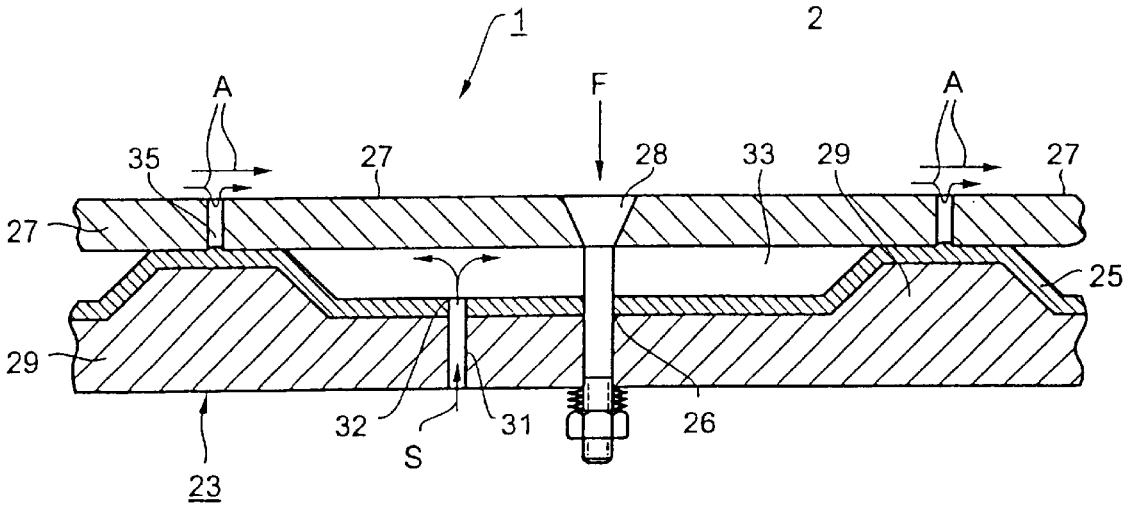
FIG. 3 shows a wall segment with a separating layer composed of a metal felt on a supporting structure provided with webs.

FIG. 3 shows a further embodiment of a wall segment 1 for a gas turbine combustion chamber which forms a combustion area 2, not shown in any more detail. The wall segment 1 comprises a metallic supporting structure 23, a heat-resistant separating layer 25 and a metallic heat protection element 27. The metallic supporting structure 3 has webs 29, which each form a contact surface for the heat protection element 27. The webs 29 are arranged such that the associated heat protection element 27 rests on the webs 29 in the region of the edge of its surface on the supporting-structure side. The heat protection element 27 thus acts like a cover closing the depression formed by the webs 29 and by parts of the supporting structure 23. At least one channel 31 for supplying sealing air S is provided between each two webs 28. The metallic heat protection element 27 is held in a sprung manner against the metallic supporting structure 23 by means of a bolt 29 (analogously to the bolt described in FIG. 1).

The separating layer 25 is in the form of a felt composed of thin, heat-resistant metal wires, which are not shown in any more detail, and lines the inner side of the supporting structure 23, facing the combustion area 2. The separating layer 25 has openings in the region of an opening 26 for the bolt 28 to pass through the supporting structure 23, and in the region of the opening 32 of the channel 31. The bolt 28 is held in the opening 26, while sealing air S can flow through the other opening, out of the channel 31 into the cavity 33 formed by the heat protection element 27 and the supporting structure 23. The heat protection element 27 deforms the separating layer 25 in the region of the webs 29. Gap openings which are formed between the contact surfaces of the heat protection element 27 and the web 29, are not shown in any more detail, and are closed by the separating layer 25, or their cross-sectional area is reduced. This prevents the sealing air S from emerging from the cavity 33 into the expansion gaps 35 formed between two heat protection elements 27, or at least reduces such flow. It is thus impossible for hot active fluid A to penetrate as far as the metallic supporting structure 23 or to flow behind the heat protection elements 27.

Figure 4:
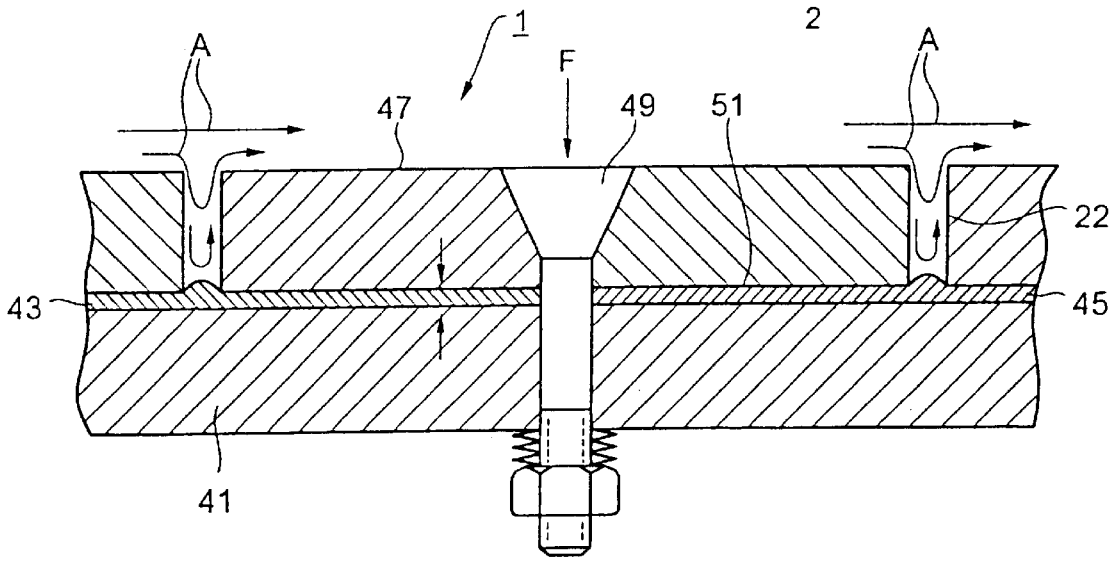
FIG. 4 shows a wall segment with a thin coating in the form of a separating layer applied to a supporting structure.

FIG. 4 shows a further embodiment of a wall segment 1. The wall segment 1 comprises a metallic supporting structure 41 with a heat protection element 47. The heat protection element 47 is linked to the supporting structure 41 in a sprung manner by means of a bolt 49, in an analogous manner to the bolt described in FIG. 1 on the inner side 43 of the supporting structure 41. A heat-resistant separating layer 45 is applied to the supporting structure 41 between the side of the supporting structure 41 facing the combustion area 2 and the side 51 of the heat protection element 47 facing away from the combustion area. The heat-resistant separating layer is in the form of a thin, heat-resistant coating 45 on the metallic supporting structure 41. The thin, deformable coating 45 fills the entire area between the heat protection element 47 and the supporting structure 41, so that irregularities of the supporting structure 41 and/or of the heat protection element 47 caused by production effects or occurring during operation of the system are compensated for. Furthermore, hot active fluid A thus cannot flow behind the heat protection element 47. The active fluid A can penetrate as far as the heat-resistant coating 45 through the expansion gaps 22 formed by adjacent heat protection elements 47. The coating 45 prevents direct contact of the active fluid A with the metallic supporting structure 41. Relative movements of the heat protection element 47 and of the supporting structure 41 can be compensated for by the elastic and/or plastic deformation of the coating 45. This avoids damage to the heat protection element and/or to the supporting structure 41.

What is claimed is:

1. A wall segment for a combustion area, to which a hot fluid can be applied, comprising:

a metallic supporting structure;

a heat protection element located above the metallic supporting structure; and a metallic, heat-resistant separating layer, fitted between the metallic supporting structure and the heat protection element and supporting the heat protection element, wherein a distance between the heat protection element and the metallic supporting structure is adjustable and, wherein the separating layer and the heat protection element protect the metallic supporting structure from the hot fluid, the separating layer being exposable to the hot fluid and the combustion chamber through gaps in the heat protection element, wherein the heat-resistant separating layer includes a metal grid with honeycomb cells and wherein the honeycomb cells are filled with a deformable filling material.

2. A wall segment for a combustion area, to which a hot fluid can be applied, comprising:

a metallic supporting structure;

a heat protection element located above the metallic supporting structure; and a metallic, heat-resistant separating layer, fitted between the metallic supporting structure and the heat protection element and supporting the heat protection element, wherein a distance between the heat protection element and the metallic supporting structure is adjustable and, wherein the separating layer and the heat protection element protect the metallic supporting structure from the hot fluid, the separating layer being exposable to the hot fluid and the combustion chamber through gaps in the heat protection element, and wherein the heat-resistant separating layer is a thin coating on the metal supporting structure.

3. The wall segment as claimed in claim 2, wherein the heat protection element is mechanically connected to the metallic supporting structure.

4. The wall segment as claimed in claim 3, wherein the heat protection element is connected to the metallic supporting structure by means of a bolt.

5. A combustion chamber including a wall segment as claimed in claim 2.

6. A gas turbine including the combustion chamber of claim 5.

7. A wall segment for a combustion area, to which a hot fluid can be applied, comprising:

a metallic supporting structure;

a heat protection element located above the metallic supporting structure; and a metallic, heat-resistant separating layer, fitted between the metallic supporting structure and the heat protection element and supporting the heat protection element, wherein a distance between the heat protection element and the metallic supporting structure is adjustable and, wherein the separating layer and the heat protection element protect the metallic supporting structure from the hot fluid, the separating layer being exposable to the hot fluid and the combustion chamber through gaps in the heat protection element, and wherein the heat-resistant separating layer is scale-resistant at a temperature of more than 500° C.

8. The wall segment of claim 7, wherein the heat-resistant separating layer is scale-resistant at a temperature of at most 800° C.

9. A wall segment for a combustion area, to which a hot fluid can be applied, comprising:

a metallic supporting structure;

a heat protection element located above the metallic supporting structure; and a metallic, heat-resistant separating layer, fitted between the metallic supporting structure and the heat protection element and supporting the heat protection element, wherein a distance between the heat protection element and the metallic supporting structure is adjustable and, wherein the separating layer and the heat protection element protect the metallic supporting structure from the hot fluid, the separating layer being exposable to the hot fluid and the combustion chamber through gaps in the heat protection element, and wherein the heat protection element is mechanically connected to the metallic supporting structure by means of a tongue-and-groove joint.

10. A wall segment for a combustion area, to which a hot fluid can be applied, comprising:

a metallic supporting structure;

a heat protection element located above the metallic supporting structure; and a metallic, heat-resistant separating layer, fitted between the metallic supporting structure and the heat protection element and supporting the heat protection element, wherein a distance between the heat protection element and the metallic supporting structure is adjustable and, wherein the separating layer and the heat protection element protect the metallic supporting structure from the hot fluid, the separating layer being exposable to the hot fluid and the combustion chamber through gaps in the heat protection element, and wherein the heat-resistant separating layer is a thin coating on the metal supporting structure and is at least one of elastically and plastically deformed by the heat protection element.

* * * * *